US009835078B2

(12) United States Patent
Won et al.

(10) Patent No.: US 9,835,078 B2
(45) Date of Patent: Dec. 5, 2017

(54) BURN PREVENTION COVER COUPLED TO PRESSURIZED COOLANT RESERVOIR TANK AND PRESSURIZED COOLANT RESERVOIR TANK ASSEMBLY HAVING THE SAME

(71) Applicants: Hyundai Motor Company, Seoul (KR); Kia Motors Corporation, Seoul (KR); Hyundai Synthetic Co., Ltd., Ansan-si (KR)

(72) Inventors: Seung-Hyun Won, Gunpo-si (KR); Yong-Han Lee, Hwaseong-si (KR); Nam-Ho Park, Hwaseong-si (KR); Moung-Ok Jeon, Ansan-si (KR)

(73) Assignees: Hyundai Motor Company, Seoul (KR); Kia Motors Corporation, Seoul (KR); Hyundai Synthetic Co., Ltd., Ansan-si (KR)

( * ) Notice: Subject to any disclaimer, the term of this patent is extended or adjusted under 35 U.S.C. 154(b) by 62 days.

(21) Appl. No.: 14/931,691

(22) Filed: Nov. 3, 2015

(65) Prior Publication Data

US 2016/0265415 A1 Sep. 15, 2016

(30) Foreign Application Priority Data

Mar. 13, 2015 (KR) ..... 10-2015-0034941

(51) Int. Cl.
*F01P 11/02* (2006.01)

(52) U.S. Cl.
CPC ..... *F01P 11/0238* (2013.01)

(58) Field of Classification Search
CPC ..... F01P 11/029; F01P 11/0285; F01P 11/00; F01P 11/0247; F01P 11/0276; F01P 2011/0252; B65D 47/2012
See application file for complete search history.

(56) References Cited

U.S. PATENT DOCUMENTS 5,357,909 A * 10/1994 Attinger ..... F01P 11/029 123/41.54
6,056,139 A * 5/2000 Gericke ..... F01P 11/0247 220/203.06

(Continued)

FOREIGN PATENT DOCUMENTS

EP 0 918 701 B1 4/2002
JP 60-18576 Y2 6/1985

(Continued)

OTHER PUBLICATIONS

Machine Translation of JP2005344687A.*

*Primary Examiner* — Long T Tran
(74) *Attorney, Agent, or Firm* — Morgan, Lewis & Bockius LLP

(57) ABSTRACT

A pressurized coolant reservoir tank assembly may include a tank having an injection port formed at an upper portion thereof, storing coolant for cooling an engine of a vehicle therein, and having a discharge hole formed to penetrate a side surface of the injection port such that steam or coolant is discharged to an outside through the discharge hole, a pressure cap fastened to the injection port such that the discharge hole is opened when the pressure in the tank reaches a predetermined pressure or the pressure cap begins to be rotated, and a burn prevention cover fitted to an outer surface of the tank with a gap between a bottom surface of the burn prevention cover and a surface of the tank such that the steam or coolant discharged through the discharge hole flows downward of the tank along the surface of the tank.

9 Claims, 11 Drawing Sheets

(56) References Cited

U.S. PATENT DOCUMENTS

| | | | | |
|---|---|---|---|---|
| 6,073,791 | A | 6/2000 | Reutter | |
| 6,378,717 | B1 * | 4/2002 | Reutter | F01P 11/0247 165/72 |
| 8,794,364 | B2 * | 8/2014 | Kasperek | B65D 39/08 180/68.4 |
| 2004/0011788 | A1 | 1/2004 | Harris | |

FOREIGN PATENT DOCUMENTS

| | | | | |
|---|---|---|---|---|
| JP | 5-73231 | U | | 10/1993 |
| JP | 2005-344687 | A | | 12/2005 |
| JP | 2013050070 | A | * | 3/2013 |
| KR | 20-1997-0040853 | U | | 7/1997 |
| KR | 10-2002-0016036 | A | | 3/2002 |
| KR | 10-2009-0109856 | A | | 10/2009 |

* cited by examiner

BURN PREVENTION COVER COUPLED TO PRESSURIZED COOLANT RESERVOIR TANK AND PRESSURIZED COOLANT RESERVOIR TANK ASSEMBLY HAVING THE SAME

CROSS-REFERENCE TO RELATED APPLICATIONS

The present application claims priority to Korean Patent Application No. 10-2015-0034941, filed Mar. 13, 2015, the entire contents of which is incorporated herein for all purposes by this reference.

BACKGROUND OF THE INVENTION

Field of the Invention

Various embodiments of the present invention relate to a pressurized coolant reservoir tank assembly for storing coolant used to cool an engine of a vehicle, and, particularly, to a burn prevention cover coupled to a pressurized coolant reservoir tank and a pressurized coolant reservoir tank assembly having the same, capable of preventing coolant from leaking during injection of the coolant and of preventing hot steam from coming into contact with an operator's hand when a pressure cap is opened.

Description of Related Art

In an engine mounted to a vehicle, coolant is used to cool heat generated by driving of the engine.

The coolant is provided to be circulated through the engine and a radiator, and a coolant reservoir tank 110 is installed in an engine room of the vehicle for replenishing the coolant.

The coolant reservoir tank 110 has an injection port 111 formed at an upper end thereof in order to inject coolant into the coolant reservoir tank 110, and a pressure cap 120 is fastened to the injection port 111.

The pressure cap 120 serves to open and close the injection port 111 of the coolant reservoir tank 110 and to discharge hot steam in the coolant reservoir tank 110 to the outside when the internal pressure of the coolant reservoir tank 110 reaches a predetermined pressure, for example, a pressure of 1.1 bars. Moreover, the pressure cap 120 should have a structure of preventing hot steam in the coolant reservoir tank 110 from spouting to an operator's hand when the operator opens the pressure cap 120.

As illustrated in FIG. 1, the pressure cap 120 is screwed to the coolant reservoir tank 110. The pressure cap 120 includes a valve 121 installed therein to move up and down, and first and second springs 122 and 123 for elastically supporting the valve 121. First and second seals 124 and 125 are provided between the coolant reservoir tank 110 and the pressure cap 120. In addition, a discharge hole 112 is formed at one side of the injection port 111 so as to communicate with a lower end of the coolant reservoir tank 110, and a discharge passage 113 is formed in a vertical direction of the coolant reservoir tank 110 so as to communicate with the lower end of the coolant reservoir tank 110 through the discharge hole 112. Consequently, the hot steam may be discharged from the coolant reservoir tank 110 through the discharge hole 112 and the discharge passage 113 to the outside.

When the internal pressure of the coolant reservoir tank 110 increases, the valve 121 moves up in a compression direction of the first and second springs 122 and 123 and the first seal 124 is opened while the second seal 125 is maintained in a closed state. Consequently, the hot steam is discharged from the coolant reservoir tank 110 through the discharge hole 112 formed at one side of the coolant reservoir tank 110 and flows to the discharge passage 113, thereby allowing the internal pressure of the coolant reservoir tank 110 to be relieved.

As illustrated in FIG. 2, when the operator rotates the pressure cap 120, the hot steam is discharged through the discharge hole 112 in the initial phase of rotation of the pressure cap 120 and is then discharged via the discharge passage 113 to the outside. When the pressure cap 120 is rotated once by the operator, the pressurized hot steam is discharged through the discharge hole 112 while only the first seal 124 is opened, thereby enabling the operator to be prevented from having a burn due to spout of the hot steam to the operator's hand.

Moreover, when the operator fully rotates the pressure cap 120, the hot steam is discharged through the discharge hole 112 and the injection port 111 while the first seal 124 is also opened, as illustrated in FIG. 3. Since the internal pressure of the coolant reservoir tank 110 in FIG. 2 is almost relieved in the state of FIG. 3, only a portion of the hot steam is discharged through the injection port 111 to the outside.

Meanwhile, when the pressure cap 120 is further rotated in the state of FIG. 3, the pressure cap 120 is fully decoupled from the coolant reservoir tank 110. When the coolant in the coolant reservoir tank 110 is insufficient, coolant is injected into the coolant reservoir tank 110 through the injection port 111 after the pressure cap 120 is decoupled from the coolant reservoir tank 110.

However, since the discharge passage 113 penetrates the center of the coolant reservoir tank 110 and is vertically formed in the coolant reservoir tank 110 according to the related art, as illustrated in FIG. 4, a portion of the coolant injected into the coolant reservoir tank 110 may leak through the discharge passage 113. A coolant leak during injection of the coolant may lead to a misunderstanding that the coolant reservoir tank 110 is damaged.

To resolve these problems, the injection port 111 should have a large size or be spaced apart from the discharge hole. However, such an increase in size causes an increase in cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a burn prevention cover coupled to a pressurized coolant reservoir tank and a pressurized coolant reservoir tank assembly having the same, capable of preventing new coolant from leaking to the outside during injection of the coolant and of preventing a misunderstanding about damage of a coolant reservoir tank due to leaking coolant by allowing the coolant to flow along a surface of the coolant reservoir tank even though the coolant leaks.

Various aspects of the present invention are directed to providing a burn prevention cover coupled to a pressurized coolant reservoir tank and a pressurized coolant reservoir tank assembly having the same, capable of preventing hot steam in a coolant reservoir tank from spouting to an operator's hand when a pressure cap is opened.

Additionally, various aspects of the present invention are directed to providing a burn prevention cover coupled to a pressurized coolant reservoir tank and a pressurized coolant reservoir tank assembly having the same, capable of allowing a pressure cap to be maintained at a certain position when the pressure cap is locked.

According to various aspects of the present invention, a cover fitted to one side of a coolant reservoir tank filled with coolant therein may be a burn prevention cover coupled to the coolant reservoir tank with a gap between a bottom surface of the burn prevention cover and a surface of the tank such that steam or coolant discharged through a discharge hole formed on a side surface of an injection port of the tank flows along the surface of the tank when the burn prevention cover is coupled to the tank.

The burn prevention cover may include a coupling hole into which a coupling protrusion formed on the coolant reservoir tank is inserted.

The burn prevention cover may include coupling slots formed on the bottom surface thereof such that the coupling slots are coupled to guides protruding from the surface of the tank in a vertical direction of the tank, the guides being spaced apart from each other on the surface of the tank.

According to various aspects of the present invention, a pressurized coolant reservoir tank assembly may include a tank having an injection port formed at an upper portion thereof, storing coolant for cooling an engine of a vehicle therein, and having a discharge hole formed to penetrate a side surface of the injection port such that steam or coolant is discharged to an outside through the discharge hole, a pressure cap fastened to the injection port such that the discharge hole is opened when the pressure in the tank reaches a predetermined pressure or the pressure cap begins to be rotated, and a burn prevention cover fitted to an outer surface of the tank with a gap between a bottom surface of the burn prevention cover and a surface of the tank such that the steam or coolant discharged through the discharge hole flows downward of the tank along the surface of the tank.

The tank may include a discharge hole cover formed at a portion thereof in which the discharge hole is formed so as to surround the discharge hole, the discharge hole cover protruding from the injection port.

The tank may include a coupling protrusion formed on the surface thereof for fitting the burn prevention cover, and the burn prevention cover may include a coupling hole into which the coupling protrusion is inserted.

The coupling protrusion may include a plurality of coupling protrusions formed at positions spaced apart from each other, and the coupling hole may include coupling holes formed in a same number as that of the coupling protrusions.

The coupling protrusion may be formed in a direction perpendicular to a vertical direction of the tank.

The tank may include guides protruding from the surface thereof so as to be directed downward of the tank along the surface of the tank, and the burn prevention cover may include coupling slots formed at the bottom surface thereof to be fitted to the guides.

The guides may be spaced apart from each other, and the coupling slots may be formed at both ends on the bottom surface of the burn prevention cover.

The discharge hole cover may have an upper surface and a side surface which are perpendicular to each other, and the pressure cap may include a locking protrusion formed at one side on a circumference thereof so as to grip both ends of the discharge hole cover when the pressure cap is fastened to the injection port.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

A burn prevention cover coupled to a pressurized coolant reservoir tank and a pressurized coolant reservoir tank assembly having the same according to various embodiments of the present invention will be described below in more detail with reference to the accompanying drawings.

Figure 1:
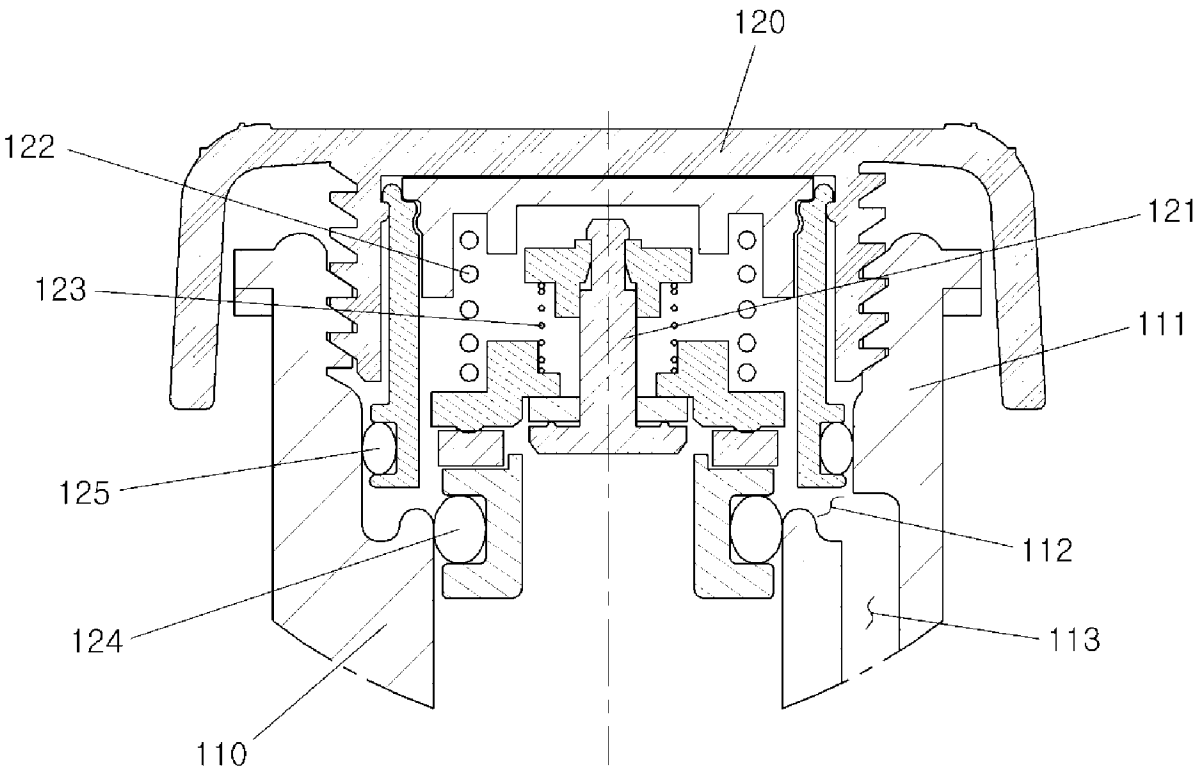
FIG. 1 (Related Art)
FIG. 1 is a partially enlarged cross-sectional view of a pressurized coolant reservoir tank assembly according to the related art.
Figure 2:
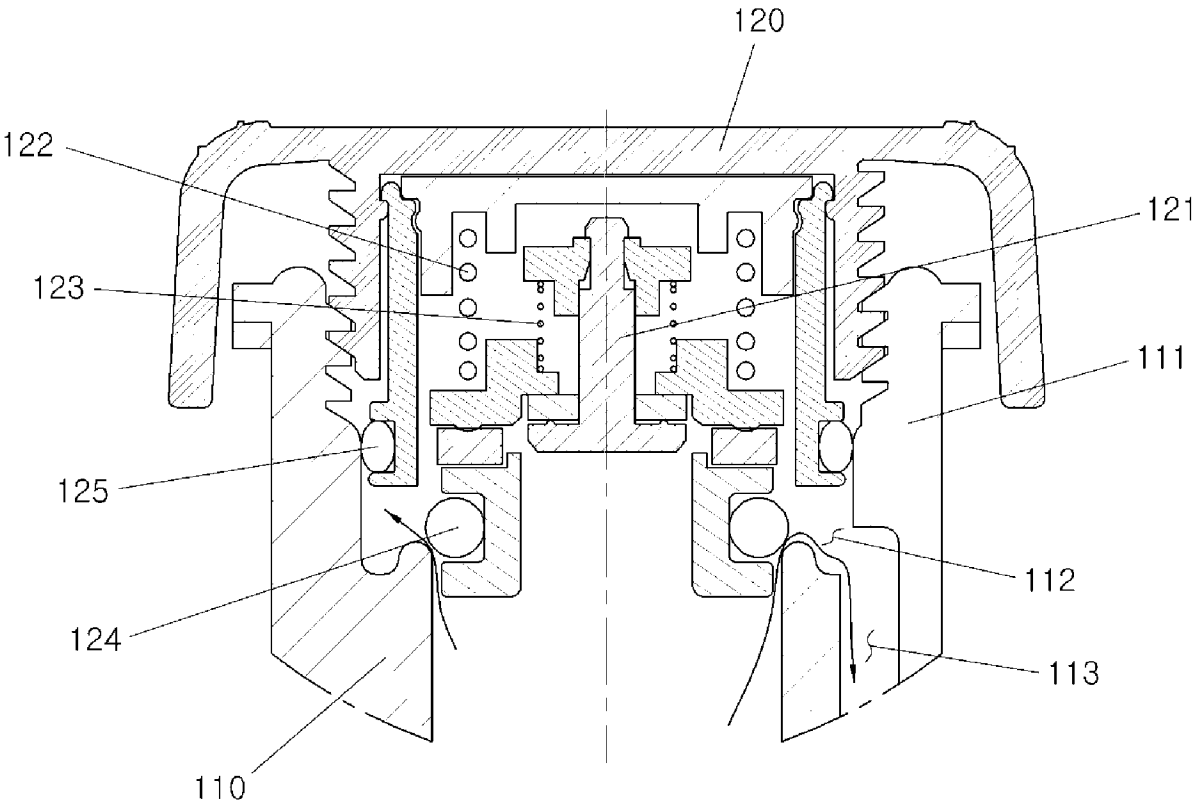
FIG. 2 (Related Art)
FIG. 2 is a cross-sectional view illustrating a state in which a pressure cap is partially rotated in FIG. 1.
Figure 3:
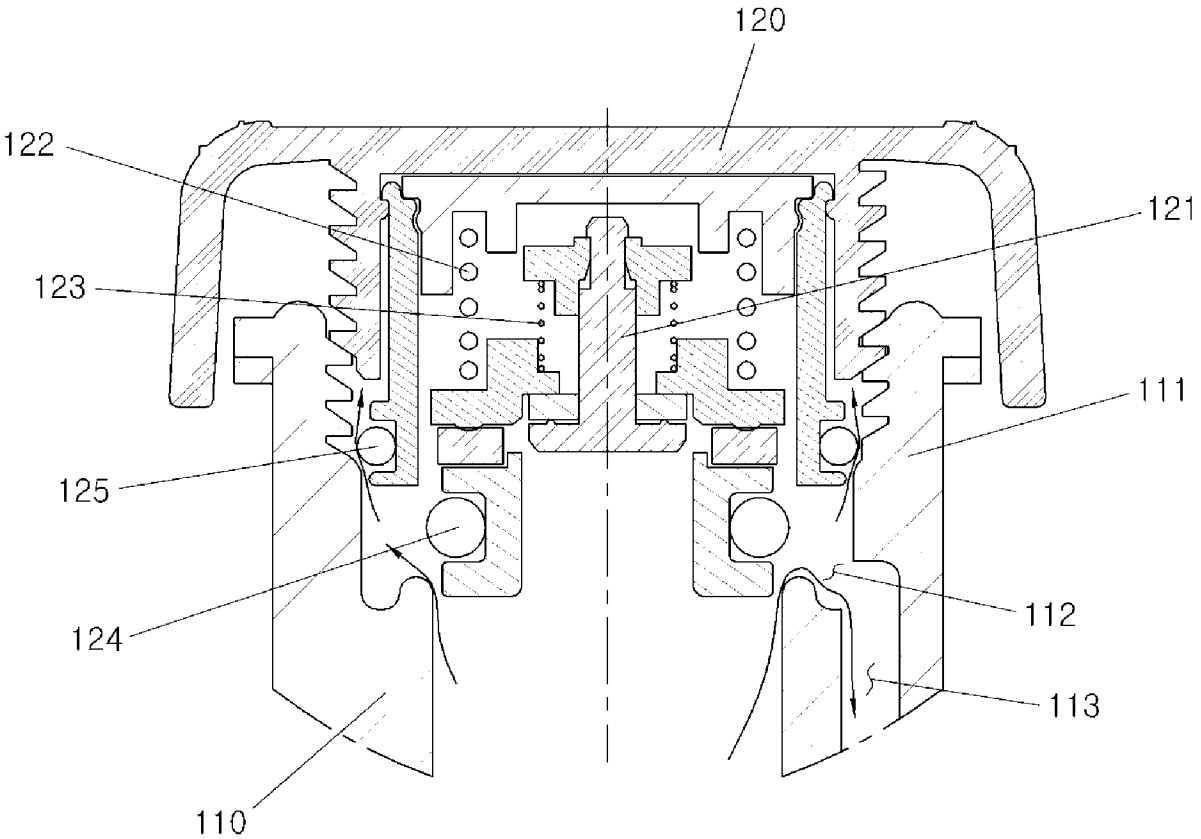
FIG. 3 (Related Art)
FIG. 3 is a cross-sectional view illustrating a state in which the pressure cap is fully rotated in FIG. 1.
Figure 4:
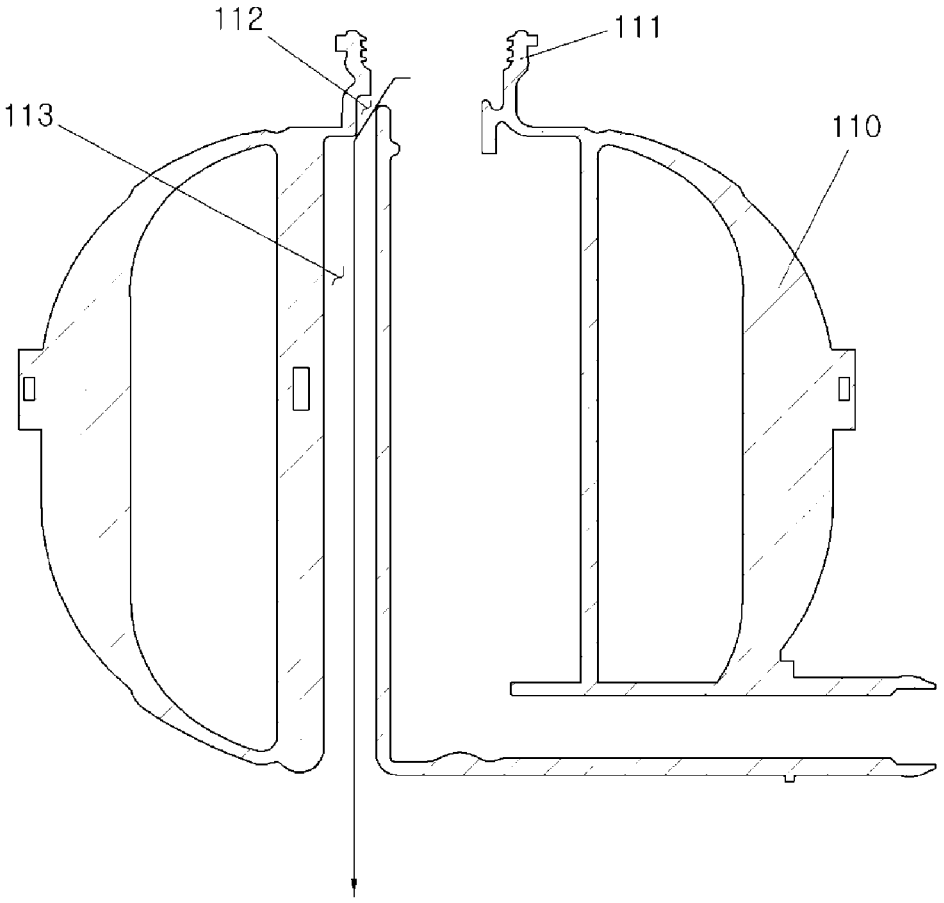
FIG. 4 (Related Art)
FIG. 4 is a cross-sectional view illustrating a state in which coolant leaks during injection of the coolant in the pressurized coolant reservoir tank assembly according to the related art.
Figure 5:
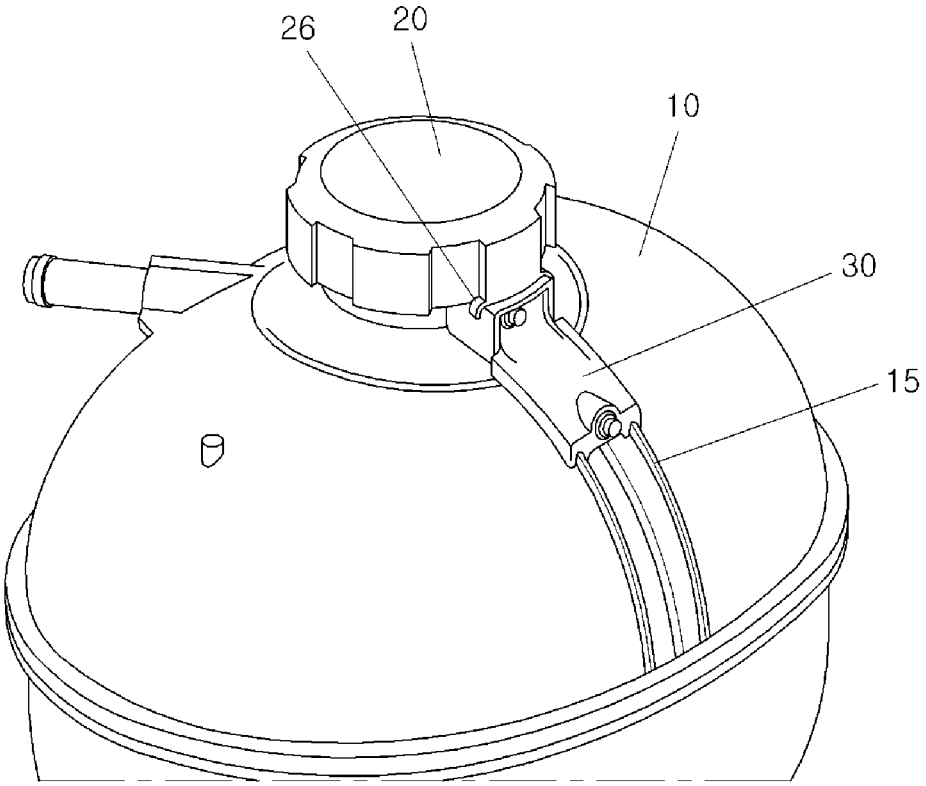
FIG. 5 is a perspective view illustrating an exemplary pressurized coolant reservoir tank assembly according to the present invention.
Figure 6:
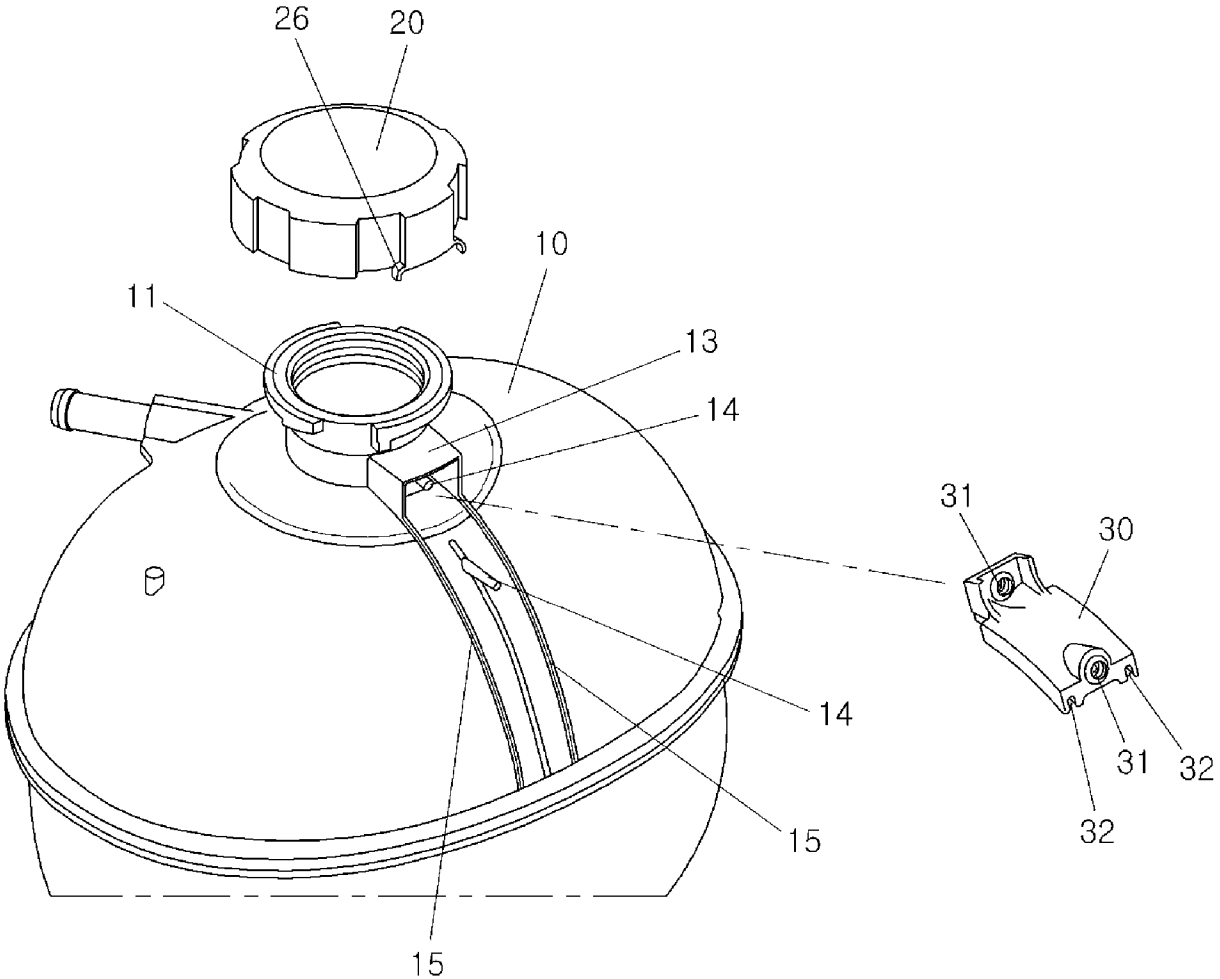
FIG. 6 is an exploded perspective view illustrating the exemplary pressurized coolant reservoir tank assembly according to the present invention.
Figure 7:
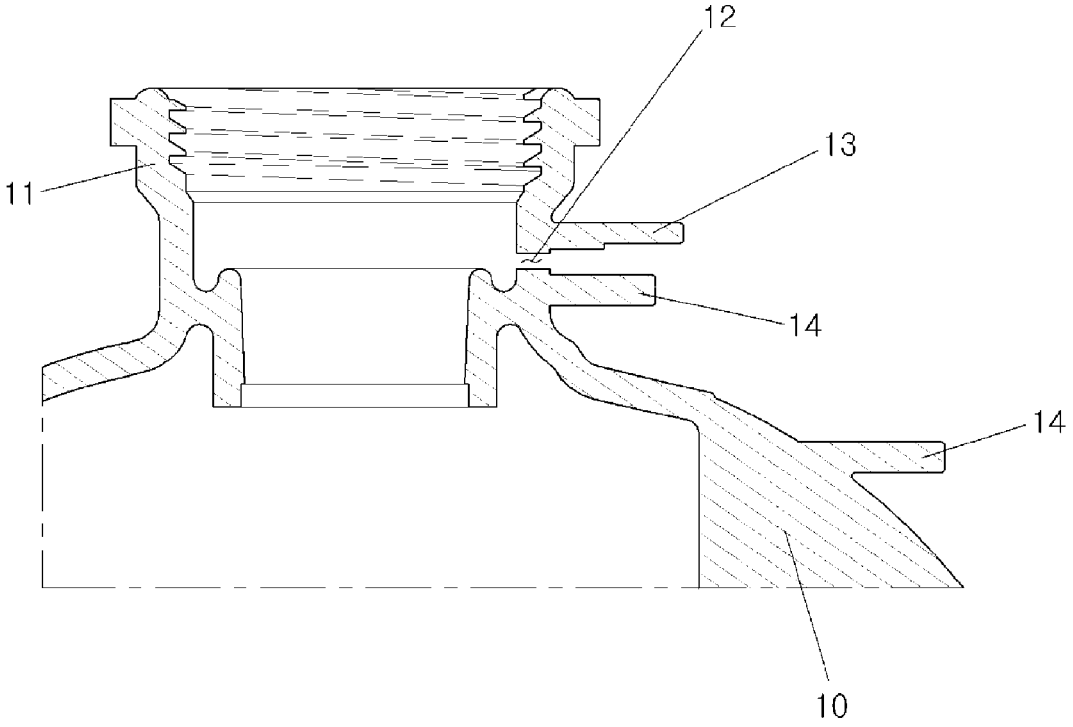
FIG. 7 is a partially enlarged cross-sectional view of the exemplary pressurized coolant reservoir tank assembly according to the present invention.

As illustrated in FIGS. 5 and 6, a burn prevention cover 30 according to various embodiments of the present invention is fitted and coupled to one side of a coolant reservoir tank 10 filled with coolant therein. The burn prevention cover 30 is coupled to the tank 10 with a gap between a bottom surface of the burn prevention cover 30 and a surface of the tank 10 such that steam or coolant discharged through a discharge hole 12 formed on a side surface of an injection port 11 of the tank 10 flows along the surface of the tank 10 when the burn prevention cover 30 is coupled to the tank 10. In addition, a pressurized coolant reservoir tank assembly according to various embodiments of the present invention includes a tank 10, which has an injection port 11 formed at an upper portion thereof, stores coolant for cooling an engine of a vehicle therein, and has a discharge hole 12 formed to penetrate a side surface of the injection port 11 such that steam or coolant is discharged to the outside through the discharge hole 12, a pressure cap 20 fastened to the injection port 11 such that the discharge hole 12 is opened when the pressure in the tank 10 reaches a predetermined pressure or the pressure cap 20 begins to be rotated, and a burn prevention cover 30 fitted to an outer surface of the tank 10 with a gap between a bottom surface of the burn prevention cover 30 and a surface of the tank 10 such that the steam or coolant discharged through the discharge hole 12 flows downward of the tank 10 along the surface of the tank 10.

The tank 10 has a space for storing coolant therein. The tank 10 has the injection port 11 formed at an upper end thereof such that coolant may be injected into the tank 10 from the outside. The tank 10 has an outlet and an inlet formed at one side thereof for circulation of coolant so that the coolant is discharged from the tank 10 through the outlet and the coolant is introduced into the tank 10 through the inlet.

The injection port 11 has the discharge hole 12 penetrating the side surface thereof. The discharge hole 12 is a hole through which hot steam or coolant is discharged to the outside. The discharge hole 12 is formed to penetrate the side surface of the injection port 12, and thus the steam or coolant discharged through the discharge hole 12 flows along the surface of the tank 10. Since the discharge hole 12 is formed to penetrate the side surface of the injection port 12, it may be possible to prevent a leakage of coolant when the coolant is injected through the injection port 11.

The tank 10 has a discharge hole cover 13 formed at a portion thereof in which the discharge hole 12 is formed so as to surround the discharge hole 12. The discharge hole cover 13 has an upper surface and a side surface which are perpendicular to each other. The upper surface and the side surface of the discharge hole cover 13 surround the discharge hole 12, and thus the hot steam or coolant discharged through the discharge hole 12 is primarily prevented from spouting upward.

The tank 10 has a coupling protrusion 14. The coupling protrusion 14 is one of coupling means for fitting the burn prevention cover 30 to the tank 10 when the burn prevention cover 30 is fastened to the tank 10. The coupling protrusion 14 is preferably provided in plural numbers in a vertical direction of the tank 10 on the surface of the tank 10. Moreover, each coupling protrusion 14 is formed in a direction perpendicular to the vertical direction of the tank 10.

The tank 10 has guides 15 protruding from the surface thereof. The guides 15 are spaced apart from each other and protrude from the surface of the tank 10 so as to be directed downward of the tank 10 from a portion of the tank 10 in which the discharge hole cover 13 is formed. The guides 15 are preferably spaced apart from each other. Since the guides 15 protrude from the surface of the tank 15, the coolant discharged through the discharge hole 12 may flow downward of the tank 10 along the guides 15.

The pressure cap 20 is fastened to the injection port 11. The pressure cap 20 closes the injection port 11 to prevent a leakage of coolant, and is decoupled from the injection port 11 during injection of the coolant.

The pressure cap 20 serves to open and close the injection port 11 and prevent the internal pressure of the tank 10 from excessively increasing. That is, when the pressure of coolant or steam generated by evaporation of the coolant increases by driving of the engine and the internal pressure of the tank reaches a predetermined pressure, the pressure cap 20 is opened to prevent the internal pressure of the tank 10 from increasing. In addition, even when the internal pressure of the tank 10 is lower than the atmospheric pressure, the pressure cap 20 allows air to be introduced from the outside such that the tank 10 is maintained under a proper pressure.

Moreover, the pressure cap 20 has a function for first discharging the hot steam or coolant to the outside in such a manner that the operator opens the pressure cap 20 when the coolant has a high temperature.

Figure 8:
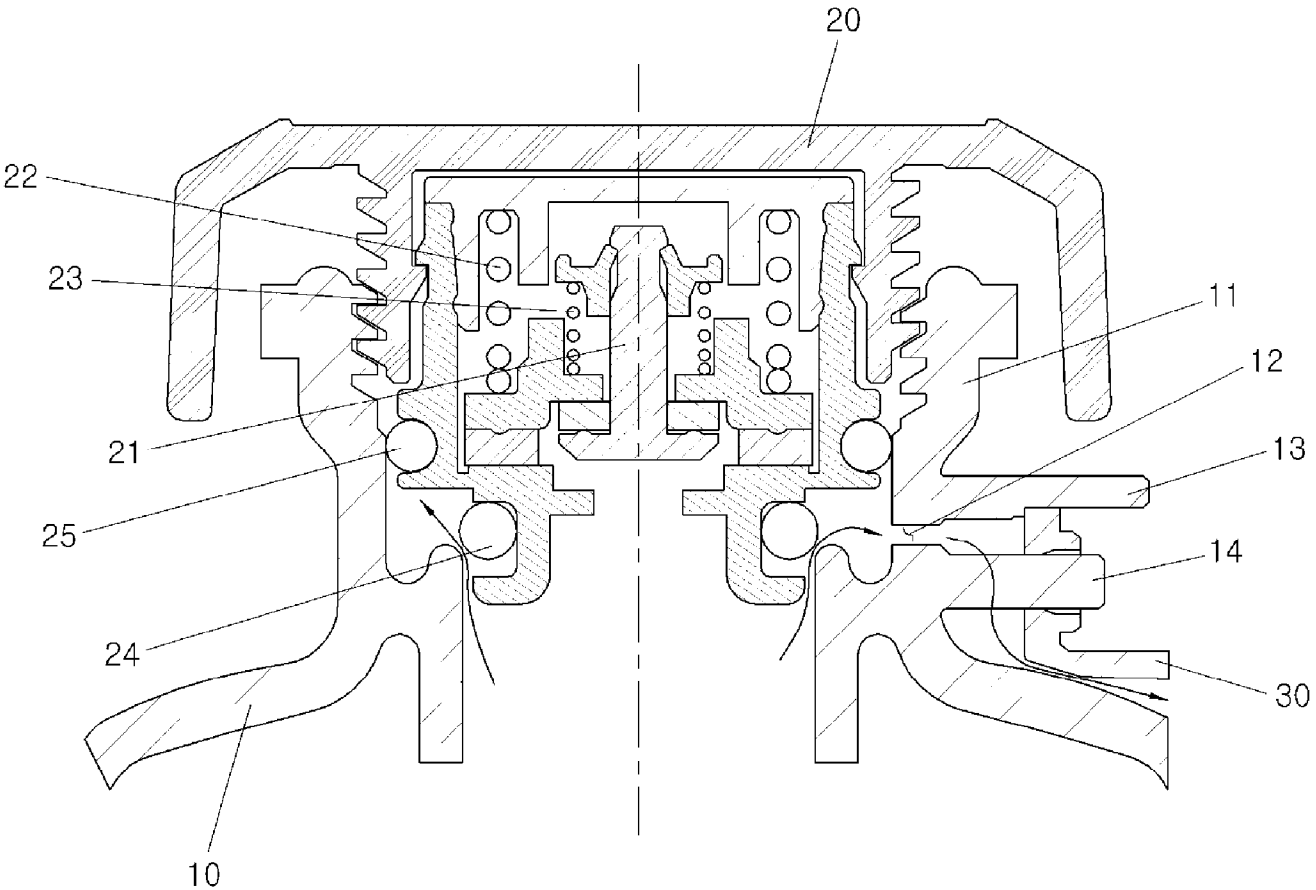
FIG. 8 is a cross-sectional view illustrating a state in which a pressure cap is rotated one and a half times in the exemplary pressurized coolant reservoir tank assembly according to the present invention.

As illustrated in FIG. 8, the pressure cap 20 includes a valve 21 provided therein to move up and down, and first and second springs 22 and 23 for vertically moving the valve 21 within the tank 10. First and second seals 24 and 25 are installed for sealing between the pressure cap 20 and the injection port 11. The first seal 24 of the first and second seals 24 and 25 is first released when the pressure cap 20 is opened.

Since the pressure cap 20 has an inner structure similar to that of a pressure cap of a typical pressurized coolant reservoir tank, detailed description thereof will be omitted.

The pressure cap 20 has a locking protrusion 26 for maintaining a state in which the pressure cap 20 is fastened to the injection port of the tank 10. The locking protrusion 26 protrudes downward from a lower end of one side on a circumference of the pressure cap 20. The locking protrusion 26 grips the discharge hole cover 13 when the pressure cap 20 is fully fastened to the injection port 11, thereby preventing release of the pressure cap 20.

The burn prevention cover 30 is fitted to the side surface of the tank 10, and thus the coolant discharged through the discharge hole 12 flows between the bottom surface of the burn prevention cover 30 and the surface of the tank 10. The burn prevention cover 30 prevents the coolant discharged through the discharge hole 12 from spouting upward, thereby preventing the operator from having a burn by the hot steam or coolant when the operator opens the pressure cap 20.

The burn prevention cover 30 has an upper end formed to close a front surface of the discharge hole cover 13 and has a bent shape along the surface of the tank 10.

The burn prevention cover 30 has coupling holes 31 into which the coupling protrusions 14 formed on the surface of the tank 10 are inserted. The coupling holes 31 are formed at the burn prevention cover 30 so as to correspond to positions at which the coupling protrusions 14 are formed on the surface of the tank 10. In addition, the coupling holes 31 are preferably formed in the same number as that of the coupling protrusions 14.

The burn prevention cover 30 has coupling slots 32 formed on the bottom surface thereof for accommodating the guides 15. A distance between the coupling slots 32 is equal to a distance between the guides 15 on the bottom surface of the burn prevention cover 30.

When the burn prevention cover 30 is assembled to the tank 10, the coupling protrusions 14 are inserted into the coupling holes 31 so that the burn prevention cover 30 may be maintained in a state of being assembled to the tank 10. In addition, since the coupling slots 32 of the burn prevention cover 30 are fitted to the guides 15, the coolant discharged through the discharge hole 12 flows downward along the surface of the tank 10 between the guides formed on the tank 10.

Effects of the pressurized coolant reservoir tank assembly according to various embodiments of the present having the above-mentioned configurations will be described.

Since the pressure cap 20 is normally fastened to the injection port 11 to the maximum degree, steam or coolant in the tank 10 is not discharged through the discharge hole 12 of the injection port 11. As such, in a state in which a certain amount of coolant is filled in the tank 10, the coolant cools the engine heated by driving while being circulated through the engine.

In addition, the locking protrusion 26 of the pressure cap 20 grips the discharge hole cover 13, the opening of the pressure cap 20 is suppressed.

Meanwhile, when the pressure cap 20 is opened or the internal pressure of the tank 10 excessively increases in a state in which the coolant is heated by the driving of the engine, the hot steam or coolant is discharged through the discharge hole 12.

FIG. 8 illustrates an initial state in which the pressure cap 20 is rotated by the operator. When the pressure cap 20 is rotated one and a half times, the pressure cap 20 begins to be decoupled from the injection port 11. In this case, the first seal 24 is first released, and thus an inner portion of the tank 10 and the discharge hole 12 are in an opened state.

Since the inner portion of the tank 10 communicates with an outer portion thereof through the discharge hole 12, the hot steam or coolant is discharged from the tank 10 through the discharge hole 12 to the outside.

In this case, the hot steam or coolant spouts by pressure at the time of discharge, thereby causing the operator's hand opening the pressure cap 20 to have a burn. However, such a burn may be prevented by the burn prevention cover 30. That is, the hot steam or coolant discharged through the discharge hole 12 is primarily prevented from spouting upward by the discharge hole cover 13. In addition, since the discharged hot steam or coolant flows along the bottom surface of the burn prevention cover 30, the hot steam or coolant is prevented from spouting toward the operator's hand.

The discharged coolant flows along the bottom surface of the burn prevention cover 30 and the surface of the tank 10 to be discharged to the outside.

Figure 9:
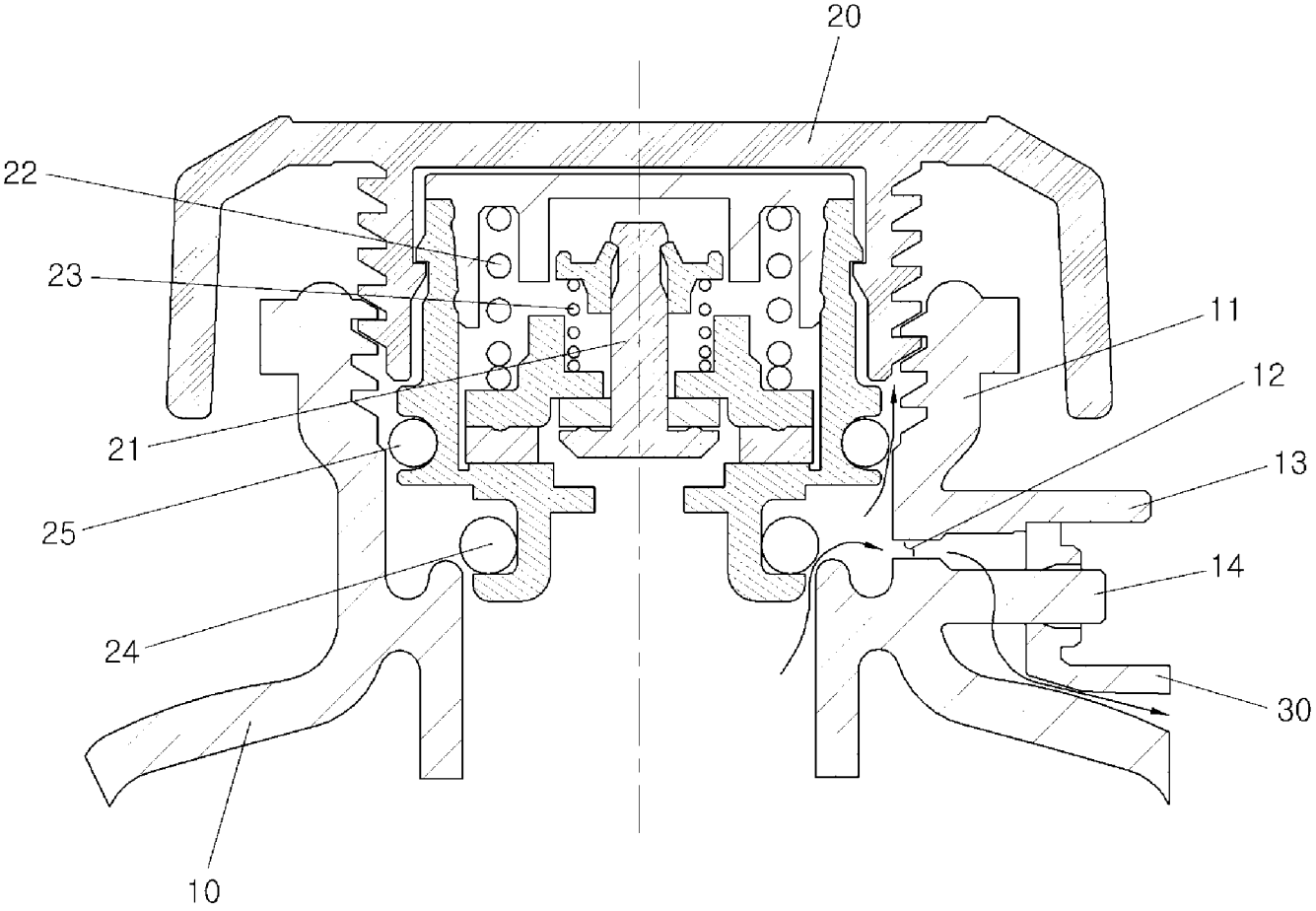
FIG. 9 is a cross-sectional view illustrating a state in which the pressure cap is rotated twice in the exemplary pressurized coolant reservoir tank assembly according to the present invention.

When the pressure cap 20 is further rotated, the steam and coolant are also discharged through the injection port 11 while the second seal 25 is opened together with the first seal 24 (see FIG. 9). In this state, since the hot steam and coolant are discharged in the initial phase of rotation of the pressure cap 20, there is not a lot of hot steam and coolant discharged through the second seal 25.

When the pressure cap 20 is further rotated in the state of FIG. 9, the pressure cap 20 is fully decoupled from the injection port 11 and the injection port 11 is exposed. In the exposed state of the injection port 11, coolant may be injected into the tank 10 from the outside.

Figure 10:
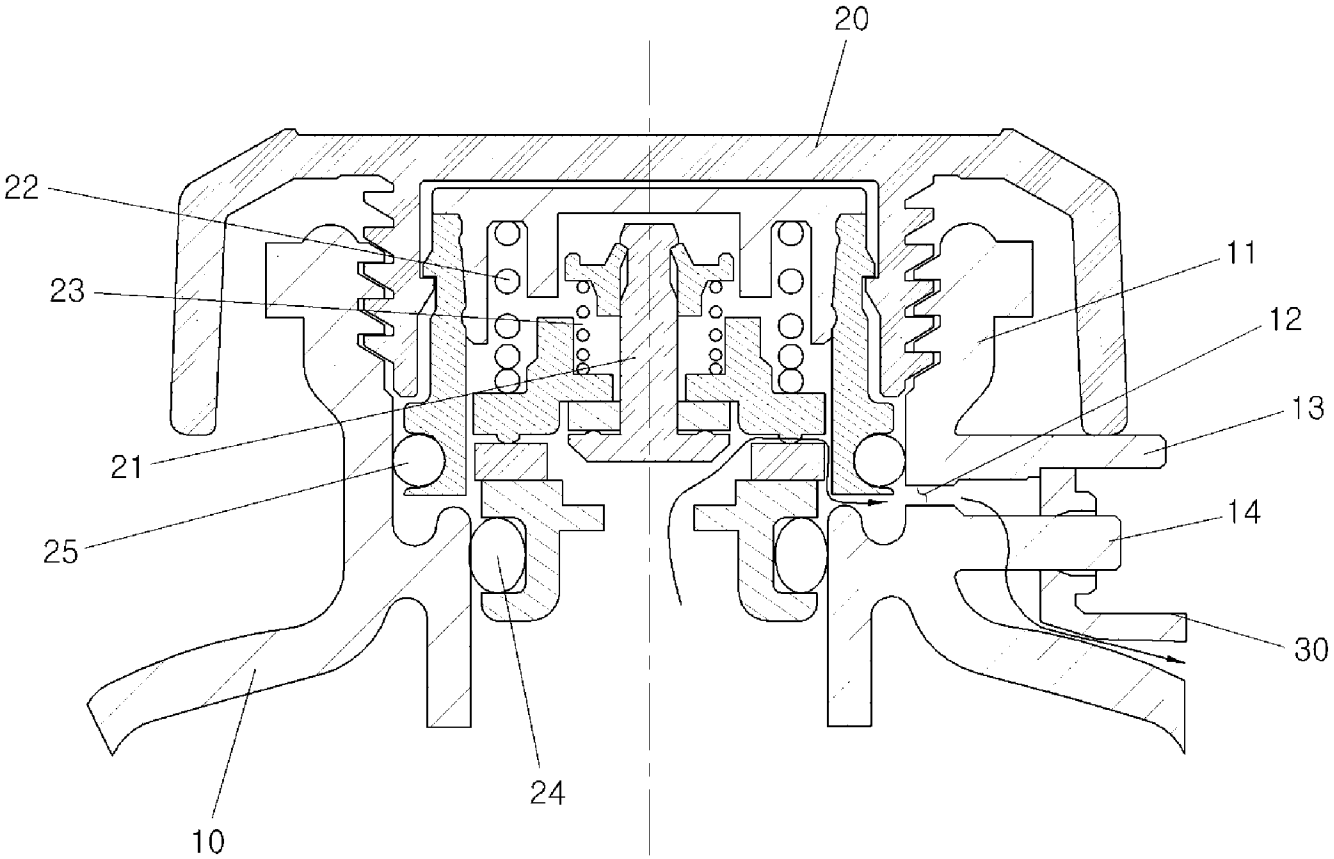
FIG. 10 is a cross-sectional view illustrating a state in which a positive pressure acts on the exemplary pressurized coolant reservoir tank assembly according to the present invention.
Figure 11:
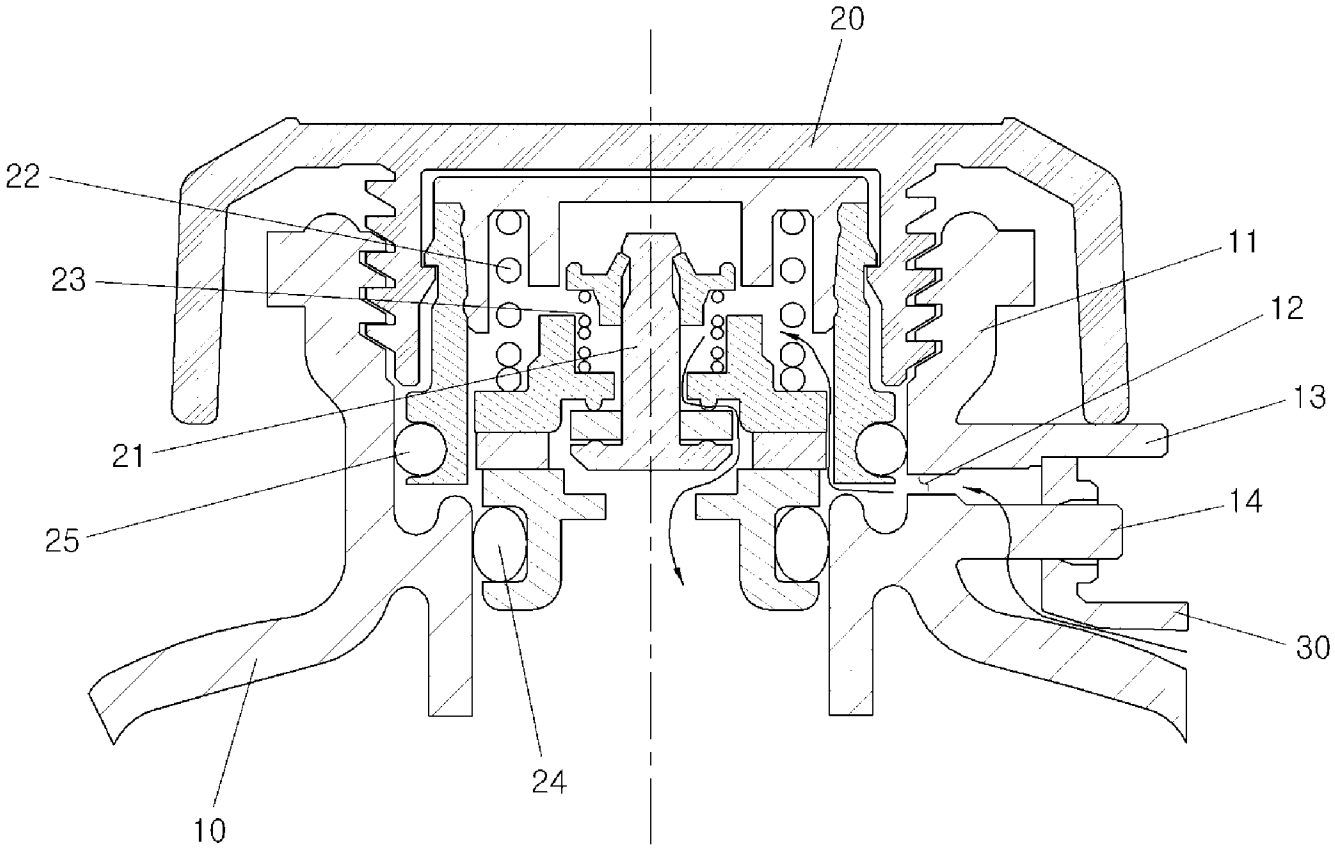
FIG. 11 is a cross-sectional view illustrating a state in which a negative pressure acts on the exemplary pressurized coolant reservoir tank assembly according to the present invention.

Meanwhile, FIGS. 10 and 11 illustrate an operation state when the internal pressure of the tank 10 is higher or lower than the atmospheric pressure.

As illustrated in FIG. 10, when the internal pressure of the tank 10 is high, the valve 21 moves up by action of the first and second springs 22 and 23 and the inner portion of the tank 10 communicates with the outer portion thereof in a state in which the sealing is maintained by the first and second seals 24 and 25. When the inner portion of the tank 10 communicates with the outer portion thereof, the steam and coolant are discharged from the inner portion of the tank 10, which is in a high-pressure state, to the outside. Consequently, the internal pressure of the tank 10 decreases and the tank 10 is maintained under a proper pressure.

FIG. 11 illustrates a state in which the internal pressure of the tank 10 is low. In this state, the valve 21 moves up by the first and second springs 22 and 23 and the inner portion of the tank 10 communicates with the outer portion thereof in a state in which the sealing is maintained by the first and second seals 24 and 25. Consequently, air is introduced into the tank 10 from the outside and thus the internal pressure of the tank 10 is not lowered than a predetermined value.

In accordance with a burn prevention cover coupled to a pressurized coolant reservoir tank and a pressurized coolant reservoir tank assembly having the same according to various embodiments of the present invention, when an operator rotates a pressure cap, steam and coolant are discharged from a tank through communication between inner and outer portions of the tank in the initial phase of rotation of the pressure cap and the discharged steam and coolant flow between a bottom surface of the burn prevention cover and a surface of the tank. Therefore, it is possible to prevent the operator from having a burn due to spout of the hot steam and coolant.

In addition, since a discharge hole is formed on a side surface of an injection port of the tank, it is possible to prevent the coolant from leaking along a discharge passage vertically formed in the tank during injection of the coolant. Moreover, it is possible to prevent a misunderstanding about damage of the tank since the coolant leaks along the discharge passage.

Furthermore, since the injection port of the tank need not have a large size for prevention of a burn and a coolant leak, an existing coolant injection gun and pressure cap can be used as they are.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cover fitted to one side of a coolant reservoir tank filled with coolant therein, the cover comprising:

a burn prevention cover coupled to the coolant reservoir tank with a gap between a bottom surface of the burn prevention cover and a surface of the tank such that steam or coolant discharged through a discharge hole formed on a side surface of an injection port of the tank flows along the surface of the tank when the burn prevention cover is coupled to the tank, wherein the burn prevention cover includes coupling slots formed on the bottom surface thereof such that the coupling slots are coupled to guides protruding from the surface of the tank in a vertical direction of the tank, the guides being spaced apart from each other on the surface of the tank.

2. The cover of claim 1, wherein the burn prevention cover includes a coupling hole into which a coupling protrusion formed on the coolant reservoir tank is inserted.

3. A pressurized coolant reservoir tank assembly comprising:

a tank having an injection port formed at an upper portion thereof, storing coolant for cooling an engine of a vehicle therein, and having a discharge hole formed to penetrate a side surface of the injection port such that steam or coolant is discharged to an outside through the discharge hole;

a pressure cap fastened to the injection port such that the discharge hole is opened when the pressure in the tank reaches a predetermined pressure or the pressure cap begins to be rotated; and a burn prevention cover fitted to an outer surface of the tank with a gap between a bottom surface of the burn prevention cover and a surface of the tank such that the steam or coolant discharged through the discharge hole flows downward of the tank along the surface of the tank, wherein the tank includes guides protruding from the surface thereof so as to be directed downward of the tank along the surface of the tank, and wherein the burn prevention cover includes coupling slots formed at the bottom surface thereof to be fitted to the guides.

4. The pressurized coolant reservoir tank assembly of claim 3, wherein the tank includes a discharge hole cover formed at a portion thereof in which the discharge hole is formed so as to surround the discharge hole, the discharge hole cover protruding from the injection port.

5. The pressurized coolant reservoir tank assembly of claim 4, wherein:

the tank includes a coupling protrusion formed on the surface thereof for fitting the burn prevention cover, and the burn prevention cover includes a coupling hole into which the coupling protrusion is inserted.

6. The pressurized coolant reservoir tank assembly of claim 5, wherein:

the coupling protrusion comprises a plurality of coupling protrusions formed at positions spaced apart from each other; and the coupling hole comprises coupling holes formed in a same number as that of the coupling protrusions.

7. The pressurized coolant reservoir tank assembly of claim 5, wherein the coupling protrusion is formed in a direction perpendicular to a vertical direction of the tank.

8. The pressurized coolant reservoir tank assembly of claim 4, wherein:

the discharge hole cover has an upper surface and a side surface which are perpendicular to each other, and the pressure cap includes a locking protrusion formed at one side on a circumference thereof so as to grip both ends of the discharge hole cover when the pressure cap is fastened to the injection port.

9. The pressurized coolant reservoir tank assembly of claim 3, wherein:

the guides are spaced apart from each other, and the coupling slots are formed at both ends on the bottom surface of the burn prevention cover.

* * * * *